US006517037B1

(12) United States Patent
Munoz

(10) Patent No.: US 6,517,037 B1
(45) Date of Patent: Feb. 11, 2003

(54) STOVE-TOP PAN HOLDING APPARATUS

(76) Inventor: Ramiro A. Munoz, 18961 Pearl St., Orange, CA (US) 92869

( * ) Notice: Subject to any disclaimer, the term of this patent is extended or adjusted under 35 U.S.C. 154(b) by 0 days.

(21) Appl. No.: 09/822,403

(22) Filed: Mar. 30, 2001

(51) Int. Cl.[7] ..... F16M 11/00
(52) U.S. Cl. ..... 248/176.2; 248/309.1
(58) Field of Search ..... 248/37.6, 176.2, 248/279.1, 277.1, 287.1, 117.2, 117.4, 309.1, 229.12, 229.22, 205.1; 126/24, 37 B

(56) References Cited

U.S. PATENT DOCUMENTS

| | | | | | |
|---|---|---|---|---|---|
| 168,809 | A | * | 10/1875 | Timby | 126/24 |
| 1,180,735 | A | * | 4/1916 | Murray | 248/205.1 |
| 1,645,466 | A | * | 10/1927 | Westlake | 126/24 |
| 2,651,489 | A | * | 9/1953 | Bell | 248/265 |
| 3,198,189 | A | | 8/1965 | Oatley | |
| 3,515,116 | A | | 6/1970 | Finnstrand | |
| 4,155,343 | A | | 5/1979 | Hartman | |
| 4,836,181 | A | | 6/1989 | Saga | |
| 5,007,608 | A | * | 4/1991 | Carroll, Jr. | 248/297.2 |
| D372,636 | S | | 8/1996 | Neff | |
| 5,575,445 | A | | 11/1996 | Kozdas | |
| 5,871,192 | A | * | 2/1999 | Horwitz | 248/309.1 |
| 6,322,030 | B1 | * | 11/2001 | Marra | 248/284.1 |

* cited by examiner

*Primary Examiner*—Leslie A. Braun
*Assistant Examiner*—A Joseph Wujciak

(57) ABSTRACT

A stove-top pan holding apparatus for providing safer conditions around stoves for children. The stove-top pan holding apparatus includes a pan holder support member being adapted to securely fastened to a stove; and also includes a pan holder being adjustably fastened to the pan holder support member for holding a handle of a pan upon the stove; and further includes fastening members for fastening the pan holder to the pan holder support member.

10 Claims, 6 Drawing Sheets

STOVE-TOP PAN HOLDING APPARATUS

BACKGROUND OF THE INVENTION

1. Field of the Invention

The present invention relates to a pan holding device and more particularly pertains to a new stove-top pan holding apparatus for providing safer conditions around stoves for children.

2. Description of the Prior Art

The use of a pan holding device is known in the prior art. More specifically, a pan holding device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,575,445; 4,836,181; 4,155,343; 3,515,116; 3,198,189; and U.S. Pat. No. Des. 372,636.

While these devices fulfill their respective, particular objectives and requirements, the aforementioned patents do not disclose a new stove-top pan holding apparatus. The inventive device includes a pan holder support member being adapted to securely fastened to a stove; and also includes a pan holder being adjustably fastened to the pan holder support member for holding a handle of a pan upon the stove; and further includes fastening members for fastening the pan holder to the pan holder support member.

In these respects, the stove-top pan holding apparatus according to the present invention substantially departs from the conventional concepts and designs of the prior art, and in so doing provides an apparatus primarily developed for the purpose of providing safer conditions around stoves for children.

SUMMARY OF THE INVENTION

In view of the foregoing disadvantages inherent in the known types of pan holding device now present in the prior art, the present invention provides a new stove-top pan holding apparatus construction wherein the same can be utilized for providing safer conditions around stoves for children.

The general purpose of the present invention, which will be described subsequently in greater detail, is to provide a new stove-top pan holding apparatus which has many of the advantages of the pan holding device mentioned heretofore and many novel features that result in a new stove-top pan holding apparatus which is not anticipated, rendered obvious, suggested, or even implied by any of the prior art pan holding device, either alone or in any combination thereof.

To attain this, the present invention generally comprises a pan holder support member being adapted to securely fastened to a stove; and also includes a pan holder being adjustably fastened to the pan holder support member for holding a handle of a pan upon the stove; and further includes fastening members for fastening the pan holder to the pan holder support member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new stove-top pan holding apparatus which has many of the advantages of the pan holding device mentioned heretofore and many novel features that result in a new stove-top pan holding apparatus which is not anticipated, rendered obvious, suggested, or even implied by any of the prior art pan holding device, either alone or in any combination thereof.

It is another object of the present invention to provide a new stove-top pan holding apparatus which may be easily and efficiently manufactured and marketed.

It is a further object of the present invention to provide a new stove-top pan holding apparatus which is of a durable and reliable construction.

An even further object of the present invention is to provide a new stove-top pan holding apparatus which is susceptible of a low cost of manufacture with regard to both materials and labor, and which accordingly is then susceptible of low prices of sale to the consuming public, thereby making such stove-top pan holding apparatus economically available to the buying public.

Still yet another object of the present invention is to provide a new stove-top pan holding apparatus which provides in the apparatuses and methods of the prior art some of the advantages thereof, while simultaneously overcoming some of the disadvantages normally associated therewith.

Still another object of the present invention is to provide a new stove-top pan holding apparatus for providing safer conditions around stoves for children.

Yet another object of the present invention is to provide a new stove-top pan holding apparatus which includes a pan holder support member being adapted to securely fastened to a stove; and also includes a pan holder being adjustably fastened to the pan holder support member for holding a handle of a pan upon the stove; and further includes fastening members for fastening the pan holder to the pan holder support member.

Still yet another object of the present invention is to provide a new stove-top pan holding apparatus that prevents pans from getting knocked off the stoves by children, in particular.

Even still another object of the present invention is to provide a new stove-top pan holding apparatus that is easy and convenient to attach to an existing stove.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
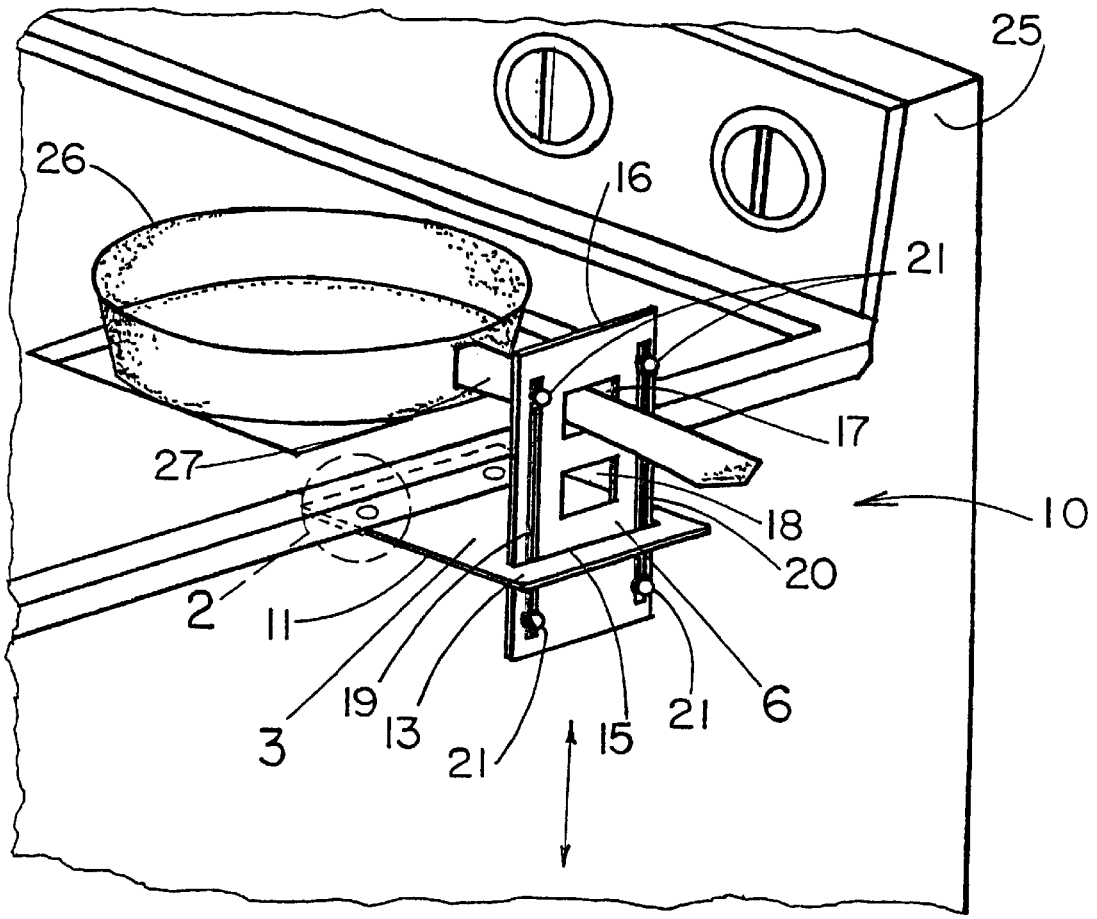
FIG. 1 is a perspective view of a new stove-top pan holding apparatus according to the present invention and shown in use.
Figure 2:
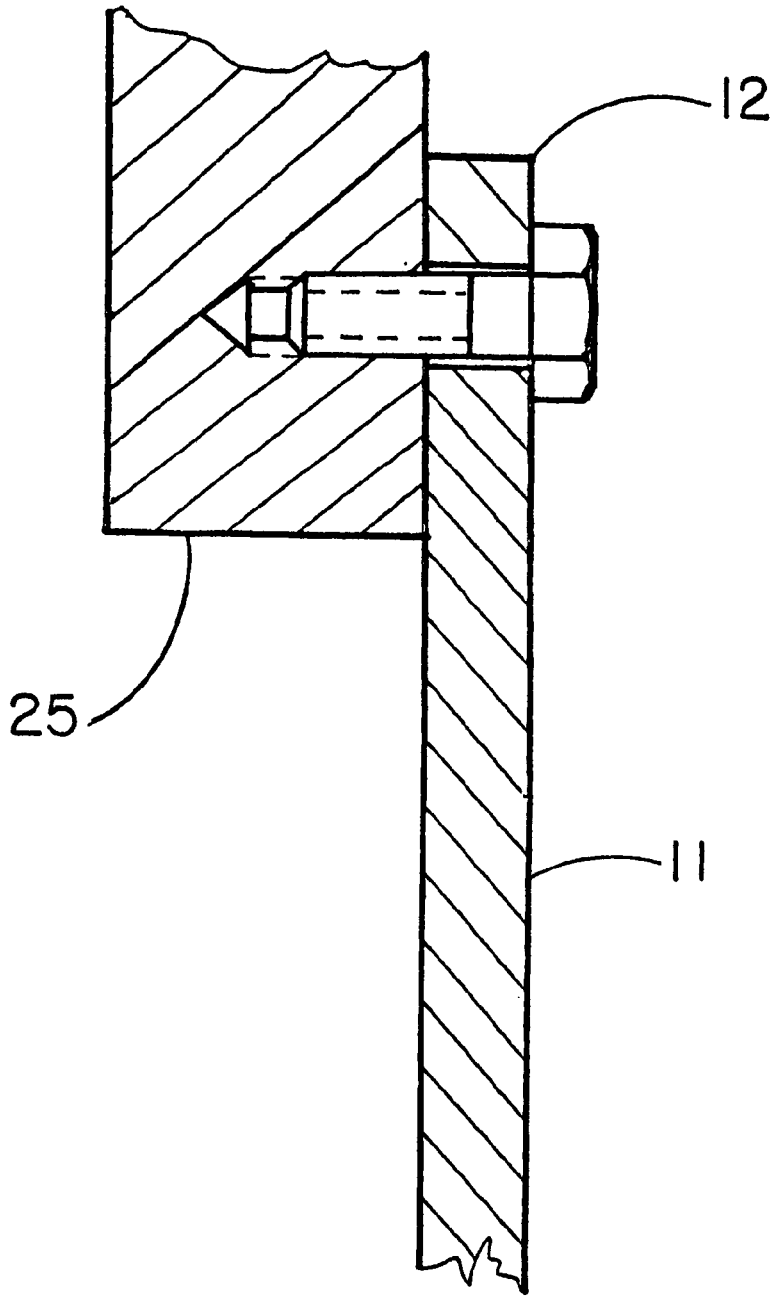
FIG. 2 is a partial cross-sectional view of the pan holder support member of the present invention.
Figure 3:
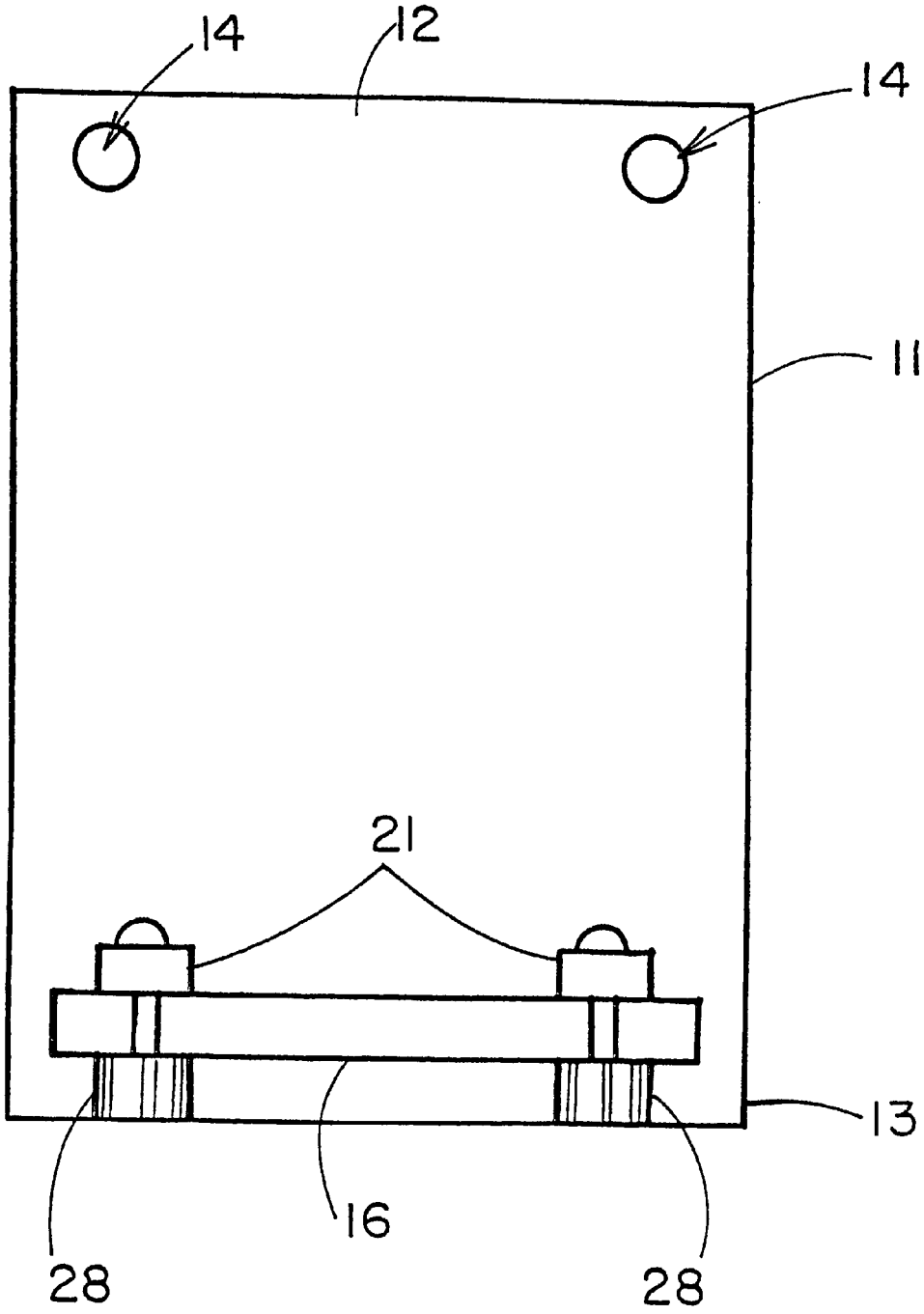
FIG. 3 is a top plan view of the present invention.
Figure 4:
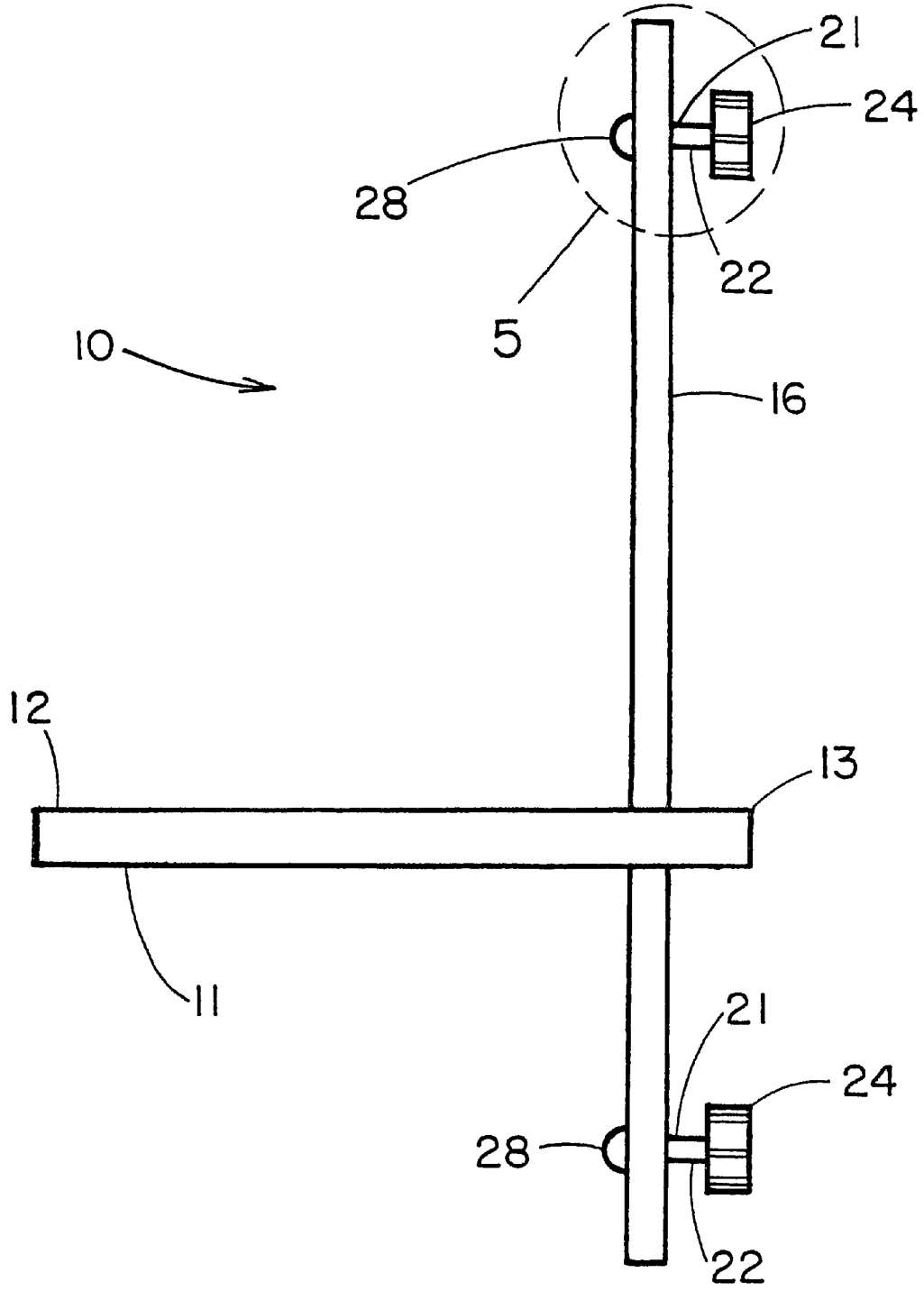
FIG. 4 is a side elevational view of the present invention.
Figure 5:
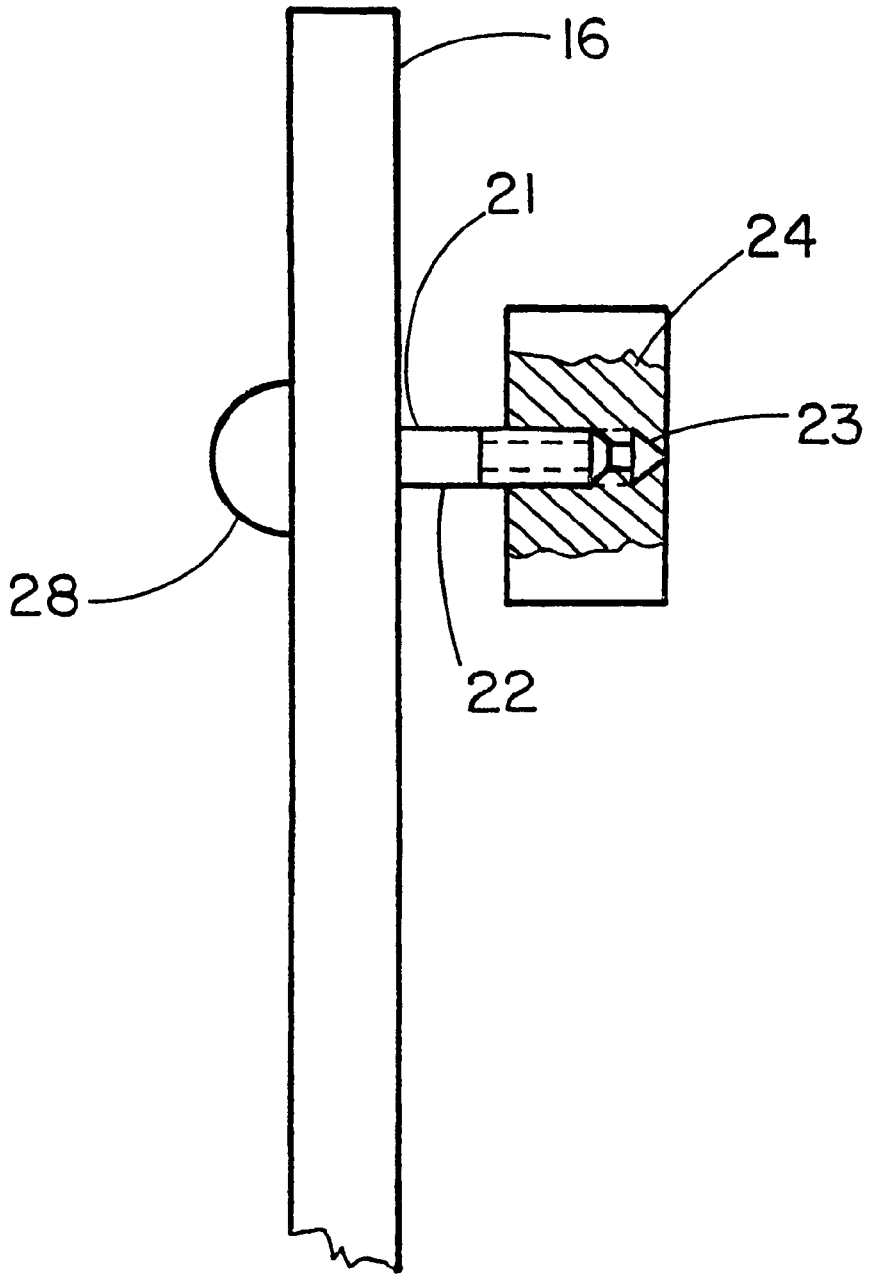
FIG. 5 is a detailed side elevational view of the present invention.
Figure 6:
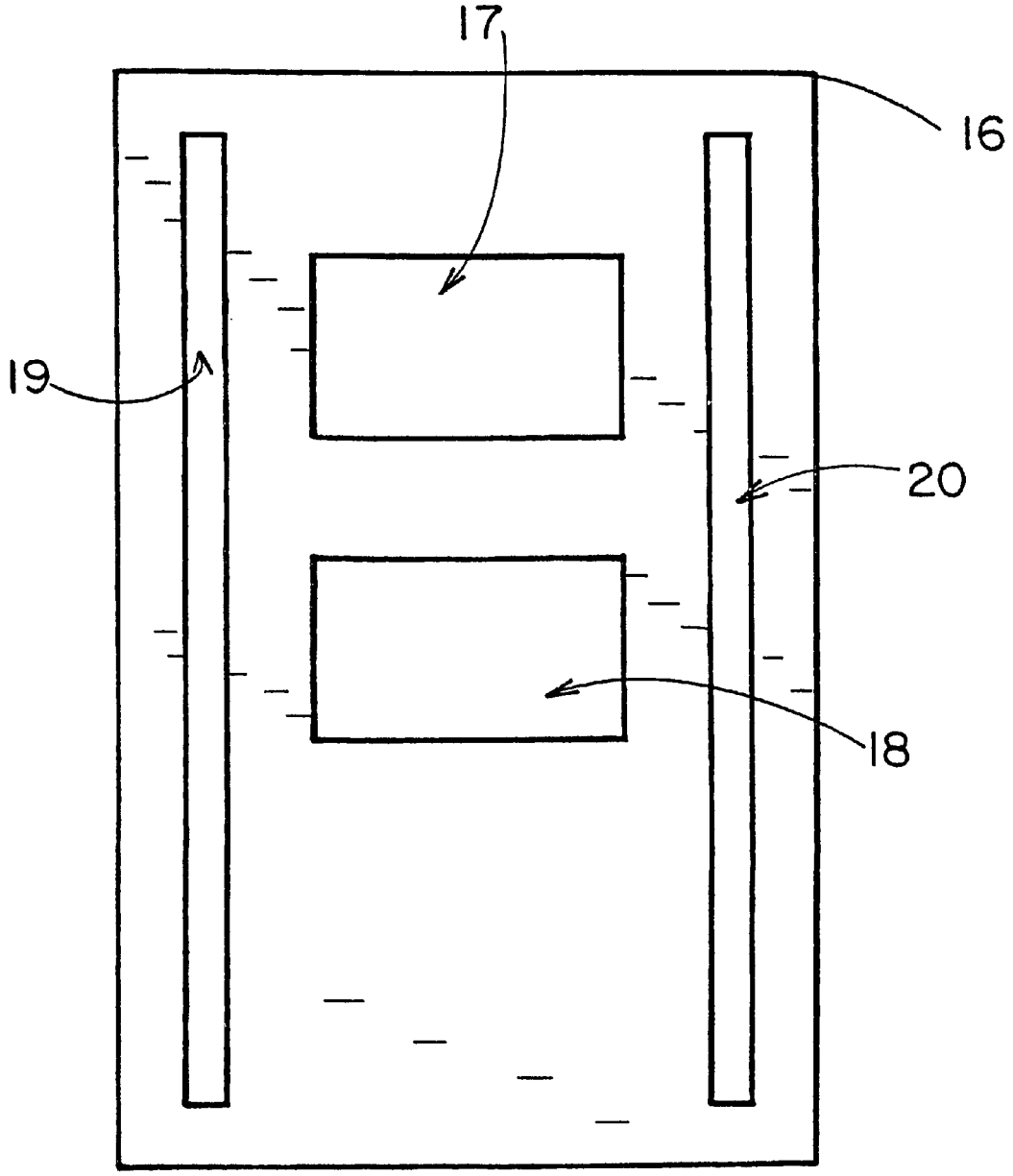
FIG. 6 is a front elevational view of the pan holder of the present invention.

With reference now to the drawings, and in particular to FIGS. 1 through 6 thereof, a new stove-top pan holding apparatus embodying the principles and concepts of the present invention and generally designated by the reference numeral 10 will be described.

As best illustrated in FIGS. 1 through 6, the stove-top pan holding apparatus 10 generally comprises a pan holder support member 11 being adapted to securely fastened to a stove 25. The pan holder support member 11 is a plate having holes 14 disposed through near a first end 12 thereof for mounting the pan holder support member 11 to an underside portion of the stove 25. The pan holder support member 11 further includes a laterally-extending slot 15 being disposed therethrough near a second end 13 thereof with the pan holder support member 11 being disposed generally horizontally and being adapted to extend forward of the stove 25.

A pan holder 16 is adjustably fastened to the pan holder support member 11 for holding a handle 27 of a pan 26 upon the stove 25. The pan holder 16 is a plate having handle-receiving openings 17,18 being vertically spaced apart and being disposed therethrough, and also having longitudinal slots 19,20 being disposed therethrough on either side of the openings 17,18 near side edges of the pan holder 16 and extending a length of the pan holder 16. The pan holder 16 is vertically and adjustably mounted in the lateral-extending slot 15 of the pan holder support member 11 with the handle-receiving openings 17,18 being adapted to receive a handle 27 of a pan 26 therethrough.

Fastening assemblies for fastening the pan holder 16 to the pan holder support member include fastening members 21 which are disposed in the longitudinal slots 19,20 of the pan holder 16, and also include nut-like cap members 24. Each of the fastening members 21 includes a shaft 22 having a pointed end 23 which is securely and movably disposed into a respective nut-like cap member 24, and also includes a head member 28 being securely and conventionally attached to an end of the shaft 22.

In use, the user slides the pan holder 16 up and down within the lateral-extending slot 15 of the pan holder support member 11 and fastens the pan holder 16 at the desired vertical position so that one of the openings 17,18 in the pan holder 16 is adapted to receive the handle 27 of the pan therethrough.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stove-top pan holding apparatus comprising:

a support member for mounting to a stove, said support member including a laterally-extending slot extending therethrough;

a pan holder for receiving a handle of a pan positioned on a top of the stove, said pan holder having a plurality of handle-receiving openings for receiving the handle of the pan therethrough when the pan is positioned on the top of the stove and the handle is extended away from an outer edge of the top of the stove;

wherein said pan holder is vertically and adjustably mounted in said lateral-extending slot of said support member; and a plurality of fastening assemblies for releasably fastening said pan holder to said support member to facilitate positioning of the handle of the pan in one of said plurality of said holes of said pan holder to inhibit inadvertent displacement of the handle of the pan.

2. A stove-top pan holding apparatus as described in claim 1, wherein said support member extends outward from the stove in a generally horizontal manner such that a plane of said support member is oriented substantially parallel to a plane of the top of the stove.

3. A stove-top pan holding apparatus as described in claim 1, wherein each of said fastening assemblies includes fastening members which are disposed in said longitudinal slots of said pan holder, and also include nut-like cap members, each of said fastening members including a shaft having a pointed end which is securely and movably disposed into a respective nut-like cap member, and also including a head member being securely attached to an end of said shaft.

4. A stove-top pan holding apparatus as described in claim 1, further comprising said support member comprising an elongate plate having a plurality of holes extending therethrough, each of said holes being positioned adjacent to a first end of said support member to facilitate mounting said support member to an underside portion of the top of the stove.

5. A stove-top pan holding apparatus as described in claim 1, wherein said laterally-extending slot of said support member is positioned adjacent to a second end of said support member.

6. A stove-top pan holding apparatus as described in claim 1, wherein each of said handle-receiving openings of said pan holder is centrally located on a longitudinal axis of said pan holder and being spacedly positioned generally adjacent to a top end of said pan holder.

7. A stove-top pan holding apparatus as described in claim 1, further comprising said pan holder having a pair longitudinal slots extending therethrough, each of said longitudinal slots being positioned on either side of said handle receiving openings adjacent to side edges of said support member.

8. A stove-top pan holding apparatus as described in claim 1, wherein each of said longitudinal slots is adapted for receiving a portion of said plurality of said fastening assemblies to facilitate vertical positioning of said pan holder with respect to said support member.

9. A stove-top pan holding apparatus comprising:

a pan holder support member being adapted to securely fasten to a stove, said pan holder support member being a plate having holes disposed therethrough near a first end thereof for mounting said pan holder support member to an underside portion of the stove, said pan holder support member further including a laterally-extending slot being disposed therethrough near a second end thereof, said pan holder support member being disposed generally horizontally and being adapted to extend forward of the stove;

a pan holder being adjustably fastened to said pan holder support member for holding a handle of a pan upon the stove, said pan holder being a plate having handle-receiving openings being vertically spaced apart and being disposed therethrough, and also having longitudinal slots being disposed therethrough on either side of said openings near side edges of said pan holder and extending a length of said pan bolder, said pan holder being vertically and adjustably mounted in said lateral-extending slot of said pan holder support member with said handle-receiving openings being adapted to receive a handle of a pan therethrough; and fastening assemblies for fastening said pan holder to said pan holder support member, said fastening assemblies including fastening members which are disposed in said longitudinal slots of said pan holder, and also including nut-like cap members, each of said fastening members including a shaft having a pointed end which is securely and movably disposed into a respective nut-like cap member, and also including a head member being securely attached to an end of said shaft.

10. A stove-top pan holding apparatus comprising:

a pan holder support member being adapted to securely fastened to a stove;

a pan holder being adjustably fastened to said pan holder support member for holding a handle of a pan upon the stove;

fastening assemblies for fastening said pan holder to said pan holder support member;

wherein said pan holder support member further includes a laterally-extending slot being disposed therethrough near a second end thereof, said pan holder support member being disposed generally horizontally and being adapted to extend forward of the stove;

wherein said pan holder support member is a plate having holes extending therethrough and being positioned generally adjacent to an end thereof for mounting said pan holder support member to an underside portion of the stove; and wherein said pan holder is vertically and adjustably mounted in said lateral-extending slot of said pan holder support member with said handle-receiving openings being adapted to receive a handle of a pan therethrough.

* * * * *